US009002254B2

(12) United States Patent
Ohtsu

(10) Patent No.: US 9,002,254 B2
(45) Date of Patent: Apr. 7, 2015

(54) SLIDING MEMBER FOR FIXING DEVICE, FIXING DEVICE, AND IMAGE FORMING APPARATUS

(71) Applicant: Fuji Xerox Co., Ltd., Tokyo (JP)

(72) Inventor: Shigemi Ohtsu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/966,607

(22) Filed: Aug. 14, 2013

(65) Prior Publication Data

US 2014/0205332 A1 Jul. 24, 2014

(30) Foreign Application Priority Data

Jan. 21, 2013 (JP) ..... 2013-008710

(51) Int. Cl.
*G03G 15/20* (2006.01)

(52) U.S. Cl.
CPC ..... *G03G 15/206* (2013.01); *G03G 15/2053* (2013.01); *G03G 15/2017* (2013.01); *G03G 2215/2009* (2013.01)

(58) Field of Classification Search
CPC ..... G03G 15/2053; G03G 15/206; G03G 15/2017; G03G 15/2025; G03G 15/2075; G03G 15/2089; G03G 2215/2009
USPC ..... 399/329, 333
See application file for complete search history.

(56) References Cited

U.S. PATENT DOCUMENTS

| | | | | |
|---|---|---|---|---|
| 6,456,819 | B1 * | 9/2002 | Abe et al. | 399/329 |
| 2003/0035667 | A1 * | 2/2003 | Izawa et al. | 399/333 |
| 2003/0103786 | A1 * | 6/2003 | Fujiwara et al. | 399/328 |
| 2006/0083567 | A1 | 4/2006 | Ito et al. | |
| 2006/0216077 | A1 * | 9/2006 | Komuro | 399/328 |
| 2009/0014942 | A1 | 1/2009 | Okuno | |
| 2013/0034374 | A1 * | 2/2013 | Ohtsu et al. | 399/329 |
| 2013/0189007 | A1 * | 7/2013 | Ohtsu | 399/329 |
| 2013/0216282 | A1 * | 8/2013 | Ohtsu | 399/329 |
| 2014/0086651 | A1 * | 3/2014 | Otsu | 399/331 |

FOREIGN PATENT DOCUMENTS

| | | |
|---|---|---|
| JP | A-2005-3969 | 1/2005 |
| JP | A-2006-119263 | 5/2006 |
| JP | A-2009-15227 | 1/2009 |

* cited by examiner

*Primary Examiner* — Benjamin Schmitt
(74) *Attorney, Agent, or Firm* — Oliff PLC

(57) ABSTRACT

Provided is a sliding member for a fixing device including in order a first fluororesin layer having a sliding surface dotted with recessed portions, a substrate, and a second fluororesin layer.

12 Claims, 6 Drawing Sheets

SLIDING MEMBER FOR FIXING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2013-008710 filed Jan. 21, 2013.

BACKGROUND (i) Technical Field

The present invention relates to a sliding member for a fixing device, a fixing device, and an image forming apparatus.

(ii) Related Art

In image forming apparatuses using electrophotography, an image is formed by fixing an unfixed toner image formed on a recording medium by a fixing device.

As this fixing device, there is known a fixing device referred to as a belt nip type with a configuration including a heating roll and a pressure belt that is arranged in contact with the heating roll or with a configuration including a heating belt and a pressure roll that is arranged in contact with the heating belt.

In the belt nip type fixing device, the belt is arranged so as to be pressed against the roll from the inner circumferential surface side by the pressing member, and a sliding member is arranged between the belt and the pressing member for the purpose of reducing sliding resistance accompanying the rotation of the belt.

SUMMARY

According to an aspect of the invention, there is provided a sliding member for a fixing device including in order: a first fluororesin layer having a sliding surface dotted with recessed portions; a substrate; and a second fluororesin layer.

BRIEF DESCRIPTION OF THE DRAWINGS

Exemplary embodiments of the present invention will be described in detail based on the following figures, wherein.

DETAILED DESCRIPTION

A sliding member for a fixing device, a fixing device, and an image forming apparatus related to the present exemplary embodiment will be described below in detail.

Sliding Member for Fixing Device

A sliding member for a fixing device related to the present exemplary embodiment (also referred to as a "sliding member") is used, for example, as a sliding member provided in a fixing device in an electrophotographic image forming apparatus. In the fixing device, lubricant (oil) is supplied to a sliding surface of the sliding member related to the present exemplary embodiment, for example, in order to reduce the sliding resistance between the sliding member and a target slide member.

An exemplary embodiment that is an example of the invention will be described referring to drawings.

Figure 1A:
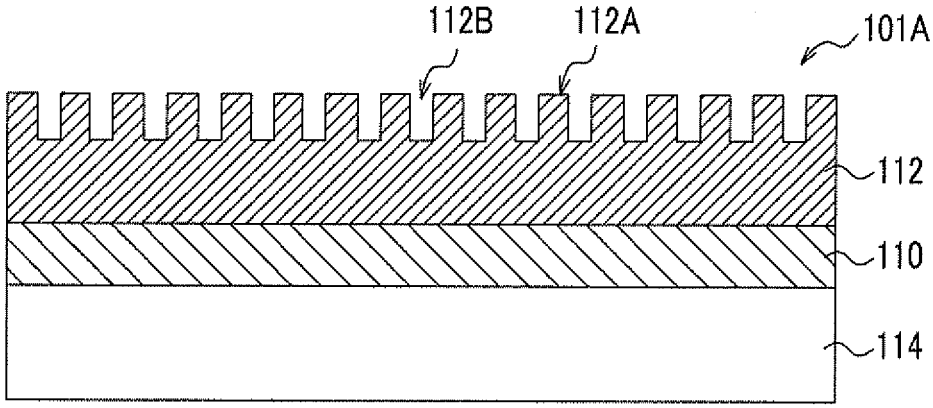
FIGS. 1A and 1B are schematic cross-sectional views showing configuration examples of sliding members for a fixing device related to the present exemplary embodiment.
Figure 1B:
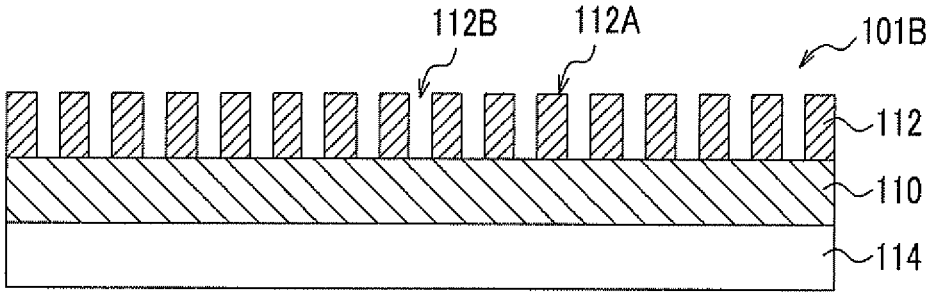

FIGS. 1A and 1B are schematic cross-sectional views showing configuration examples of sliding members related to the present exemplary embodiment.

A sliding member 101A shown in FIG. 1A includes a substrate 110, a first fluororesin layer 112 provided on one surface of the substrate 110, and a second fluororesin layer 114 provided on the other surface of the substrate 110. The first fluororesin layer 112 has a sliding surface 112A dotted with the recessed portions 112B, and the recessed portions 112B are provided in the first fluororesin layer 112 as holes that do not penetrate this layer.

A sliding member 101B shown in FIG. 1B includes the substrate 110, the first fluororesin layer 112 provided on one surface of the substrate 110, and the second fluororesin layer 114 provided on the other surface of the substrate 110. The first fluororesin layer 112 has the sliding surface 112A dotted with the recessed portions 112B, and the recessed portions 112B are provided as through holes in the first fluororesin layer 112.

In addition, an adhesive layer for bonding the substrate 110 and the first fluororesin layer 112 and an adhesive layer for bonding the substrate 110 and the second fluororesin layer 114 are not shown.

Since the sliding member 101A and the sliding member 101B related to the present exemplary embodiment have the first fluororesin layer 112, the substrate 110, and the second fluororesin layer 114 in this order, the deformation caused from heat during the manufacturing is suppressed. This reason is inferred as follows.

In the related art, a laminated sheet in which a fluororesin layer that is one layer and a substrate that is another layer are laminated via an adhesive layer is known as a sliding member.

The substrate includes a resin, such as a polyimide, for the purpose of improving the heat resistance or the strength of the sliding member, for example.

The fluororesin layer configures a sliding surface of the sliding member, and recessed portions are provided so as to be dotted in the sliding surface for the purpose of holding and supplying lubricant to a contact region with a target sliding member and for the purpose of reducing the area of the contact region and keeping a frictional coefficient low.

As a method of making the laminated sheet, for example, there is a method of applying pressure and heat to a laminate in which a fluororesin layer and a substrate are laminated via an adhesive sheet, and thermally fusing the adhesive sheet, thereby pasting the fluororesin layer and the substrate together.

Additionally, as a method of forming the recessed portions in the fluororesin layer, for example, there is a method of pressing a die having convex portions on a pressing surface against a fluororesin sheet that becomes the fluororesin layer, heating the fluororesin sheet to the glass transition temperature or higher of a fluororesin, and forming the recessed portions or through holes in the fluororesin sheet.

However, if the laminate of the fluororesin layer and the substrate is heated and pressurized when the fluororesin layer and the substrate are pasted together or when the recessed portions are formed in the fluororesin layer, deformation may be caused such that the finished sliding member is deflected, bent, or wound with the fluororesin layer being located on the inner side. The sliding member that is deformed in this way is not easily attached to the fixing device.

It is believed that that above deformation occurs because the fluororesin layer easily expand thermally in a planar direction when being heated and pressurized compared to the substrate and does not easily return to original dimensions even when being cooled.

In contrast, the sliding member 101A and the sliding member 101B related to the present exemplary embodiment have the fluororesin layers on both surfaces of the substrate. As a result of the fact that these sliding members are usually manufactured by pasting the laminate in which the fluororesin layer, the substrate, and the fluororesin layer are laminated in this order as mentioned above and forming the recessed portions in one fluororesin layer as mentioned above, it is believed that, when the laminate is heated and pressurized and is cooled in manufacturing processes, the degrees of deformation of the fluororesin layers on both surfaces balance each other, and the deformation, such as deflection, bending, or winding of the sliding members, is suppressed.

In the sliding member 101A and the sliding member 101B related to the present exemplary embodiment, it is believed that the deformation caused by heat during manufacture is suppressed due to the above reason.

Accordingly, when the sliding member 101A and the sliding member 101B related to the present exemplary embodiment have the following aspect, the effects obtained by the configuration of the invention are significant.

That is, the invention provides a sliding member for a fixing device in which a laminate is made by laminating a sheet that becomes the first fluororesin layer, a sheet that becomes a substrate, and a sheet that becomes the second fluororesin layer are laminated via the adhesive sheet that is thermally fused, and the laminate is heated and pressurized and pasted together.

Additionally, the invention provides a sliding member for a fixing device in which the recessed portions are dotted in the sliding surface by pressing and heating the die having the convex portions on the pressing surface against the surface of the first fluororesin layer of the laminated sheet that has the first fluororesin layer, the substrate, and the second fluororesin layer in this order.

The respective layers that configure the sliding member 101A and the sliding member 101B that are shown in FIGS. 1A and 1B will be described in detail.

In the following, a "principal component" means being 50% or more in a weight ratio.

Substrate

The substrate 110 is sheet-like, for example, and may contain additives, such as a filling material, including a resin material.

The resin material includes, for example, a polyimide resin, a polyamide resin, a polyamide-imide resin, a polyether-ester resin, a polyarylate resin, a polyester resin, or a polyester resin obtained by adding a reinforcing material. Among them, the polyimide resin with high heat resistance and mechanical strength is preferable.

The thickness of the substrate 110 may be, for example, from 50 μm to 150 μm, and be preferably from 60 μm to 130 μm.

First Fluororesin Layer

The first fluororesin layer 112 is a layer that contains the fluororesin as a principal component, and may also contain additives, such as a filling material.

The resin that configures the first fluororesin layer 112 includes polytetrafluoroethylene (PTFE), perfluoroalkoxyalkane, an ethylene-tetrafluoroethylene copolymer, or the like.

From a viewpoint of the durability of the sliding member, the first fluororesin layer 112 is preferably a layer that contains a bridged fluororesin as a principal component, and particularly, the first fluororesin layer is preferably a layer that contains bridged polytetrafluoroethylene (hereinafter referred to as "bridged PTFE") as a principal component.

The bridged PTFE include, for example, PTFE obtained by irradiating and bridging unbridged PTFE with ionizing radiation. Specifically, the bridged PTFE is, for example, PTFE obtained by irradiating and bridging unbridged PTFE in the state of being heated to a higher temperature than a crystalline melting point with ionizing radiation (for example, a gamma ray, an electron ray, an X ray, a neutron ray, a high-energy ion, or the like) with an irradiation dose ranging from 1 KGy to 10 MGy under the environment of oxygen absence.

PTFE may contain copolymerization components other than tetrafluoroethylene, for example, perfluoro (alkylvinylether), hexafluoropropylene, perfluoro (alkylvinylether), hexafluoropropylene, ethylene (perfluoroalkyl), chlorotrifluoroethylene, or the like.

The filling material is a substance added for the purpose of giving electrical conductivity or thermal conductivity or improving durability.

The filling material is preferably at least one kind selected from a metal oxide particle, a silicate mineral, carbon black, and a nitrogen compound.

Among them, Ketjen black, black lead, and acetylene black are preferable in giving electrical conductivity, and black lead, copper, silver, aluminum nitride, boron nitride, and alumina are preferable in giving thermal conductivity.

One kind of filling material may be use, or and two or more kinds of filling material may be used.

The average particle diameter of a filling material is desirably from 0.01 μm and 20 μm.

When the filling material is used, the content thereof is desirably from 0.01 parts by weight to 30 parts by weight with respect to 100 parts by weight of the fluororesin.

Although the thickness of the first fluororesin layer 112 is set according to the shape of the layer, the rigidity of the layer, or the property of the substrate 110, 20 μm to 500 μm are preferable, and 50 μm to 400 μm is more preferable.

Second Fluororesin Layer

The second fluororesin layer 114 is a layer that contains the fluororesin as a principal component, and may also contain additives, such as a filling material.

Since both the first fluororesin layer 112 and the second fluororesin layer 114 are layers that contain the fluororesin as a principal component, the coefficients of thermal expansion of both layers approximate each other. Thus, it is believed that, when the layers are heated and pressurized, the degrees of deformation of both layers are almost the same.

The resin that configures the second fluororesin layer 114 includes polytetrafluoroethylene (PTFE), perfluoroalkoxyalkane, an ethylene-tetrafluoroethylene copolymer, or the like.

From a viewpoint of the durability of the sliding member, the second fluororesin layer is preferably a layer that contains the bridged fluororesin as a principal component, and more preferably a layer that contains bridged PTFE as a principal component.

From a viewpoint of compatibility between the durability of the sliding member and manufacturing costs, the second fluororesin layer is preferably a layer that contains an unbridged fluororesin as a principal component, and more preferably a layer that contains unbridged PTFE as a principal component.

The type, the average particle diameter, and the content of the filler material are illustrated with respect to the first fluororesin layer 112.

From a viewpoint of efficiently suppressing the deformation (for example, deflection, bending, or winding) caused by heat during manufacture of the sliding member, the thickness of the second fluororesin layer 114 is preferably 0.8 to 1.2 times and more preferably 0.9 to 1.1 times greater than the thickness of the first fluororesin layer 112.

Adhesive Layer

An adhesive layer that bonds one layer and another layer are present between the respective layers laminated in the thickness direction of the sliding member.

The adhesive layer may be a layer formed from well-known adhesives, such as a heat-resistant silicone resin or an epoxy-based resin, or layers formed using adhesive sheets.

When the sliding member related to the present exemplary embodiment has an aspect in which the through holes are provided in the first fluororesin layer 112 as the recessed portions 112B as in the sliding member 101B, in order for the through holes not to be buried, it is more preferable to use an adhesive sheet rather than an adhesive, or an adhesive sheet that has holes with the same shape as the through holes may be used.

The adhesive sheet is preferably an adhesive sheet that may be thermally fused by being heated to a melting point or higher and may bond the laminated respective layers. In addition, a fluorine-based adhesive sheet is preferable from a viewpoint that the adhesive sheet does not react with lubricant (oil) and degradation caused lubricant (oil) and degradation of lubricant (oil) do not occur easily. Specifically, the adhesive sheet includes trade name Silky Bond (made by Junkosha Inc).

The thickness of the adhesive sheet is preferably from 10 μm to 30 μm.

Recessed Portion

The recessed portions 112B are provided in the sliding surface for the purpose of holding lubricant (oil) and supplying the lubricant (oil) to the contact region with the target sliding member, and for the purpose of reducing the area of the contact region and keeping the frictional coefficient low.

Array Pattern of Recessed Portion

The recessed portions 112B are preferably dotted in a cyclic array in the sliding surface.

The cyclic array is not particularly limited and includes, for example, an array pattern that has a lattice or a face-centered lattice as a unit. The lattice may be in any shapes of a square, a rectangle, a lozenge, and other parallelograms. The face-centered lattice means a structure that has the total of five points including peaks and an intersection point between diagonal lines in a parallelogram as a lattice point of a unit lattice. It is obvious that a square, a rectangle, and a lozenge are included in the parallelogram.

Although the cyclic array may break off or may have been shifting, it is preferable to continuously repeat the cyclic array without gap in all directions.

As for the cyclic array, the array cycle (array pitch) is desirably from 0.2 mm to 2.0 mm, and more preferably from 0.3 mm to 1.5 mm.

Here, the array cycle (array pitch) means the distance between the central points of two adjacent unit lattices. The central point is an intersection point between diagonal lines when the unit lattice is a quadrangle.

In addition, plural array cycles (array pitches) may be present according to the form of unit lattices. (For example, if the form of a unit lattice is a rectangle, there are two array cycles in a longitudinal direction and a lateral direction). When there are plural array cycles (array pitch), it is preferable that all array cycles are within the above range.

As for the cyclic array, the distance between adjacent recessed portions is preferably from 0.3 mm to 1.0 mm, and more preferably from 0.4 mm to 0.8 mm.

A preferable array pattern of the recessed portions 112B will be described below with reference to the drawings. An array pattern to be described below may be referred to as "pattern in which the central lattice point of the face-centered lattice may be shifted".

Figure 2:
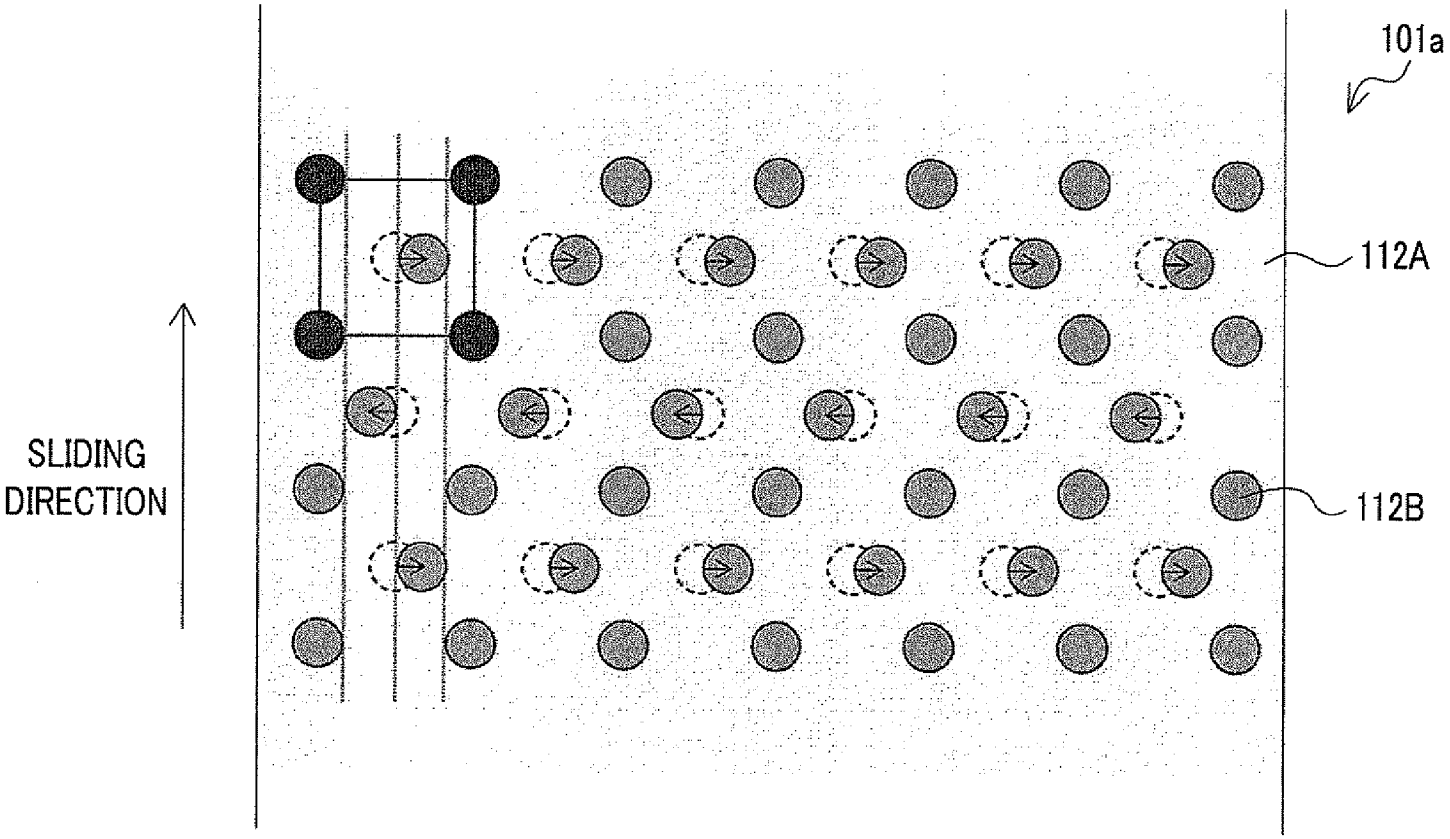
FIG. 2 is a schematic plan view showing an example of an array pattern of recessed portions in a sliding surface of a sliding member for a fixing device related to the present exemplary embodiment.

FIG. 2 is a schematic plan view showing an example of an array pattern of recessed portions in a sliding surface of a sliding member related to the present exemplary embodiment, and a view showing the sliding surface in a plan view.

Figure 3:
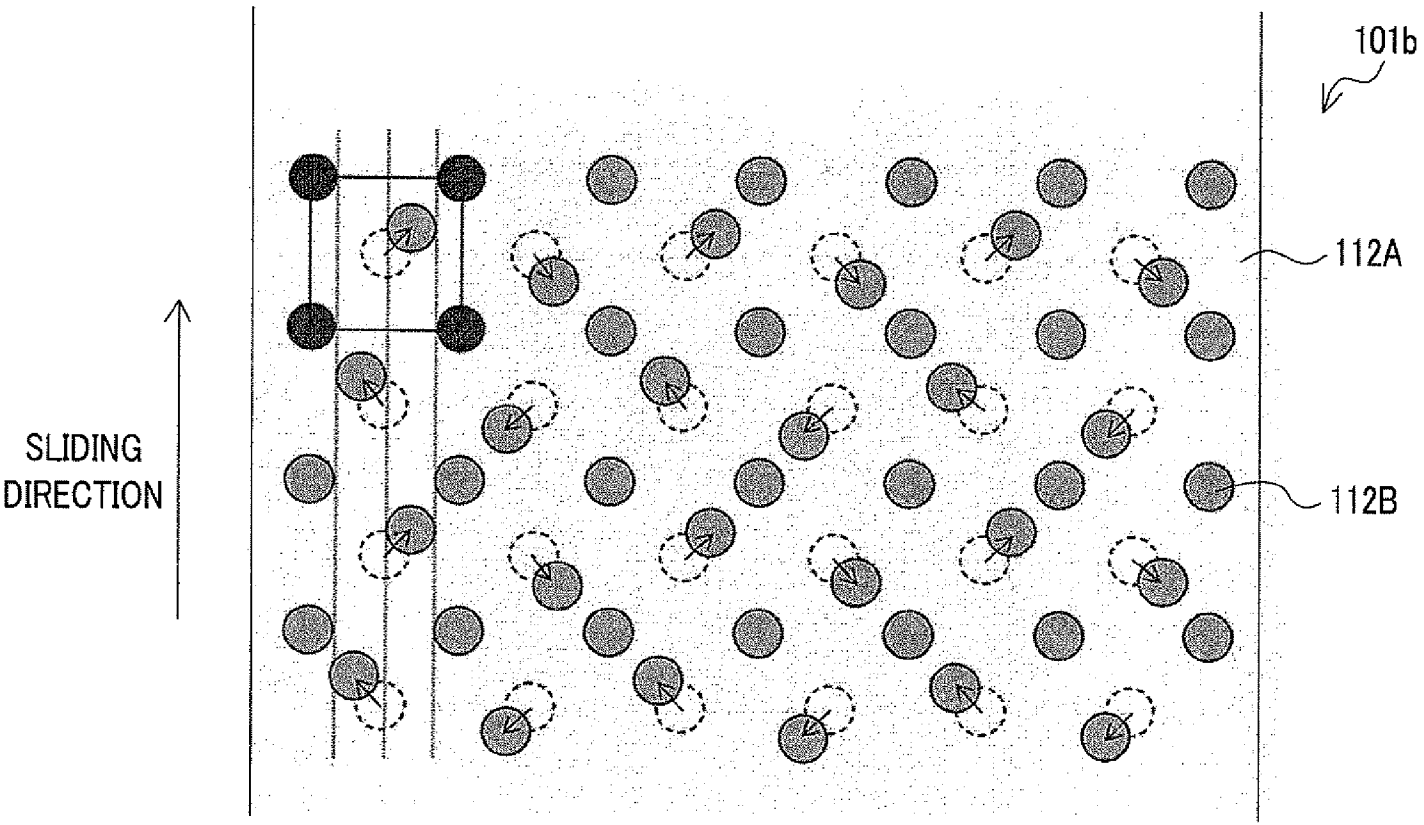
FIG. 3 is a schematic plan view showing another example of an array pattern of recessed portions in a sliding surface of a sliding member for a fixing device related to the present exemplary embodiment.

FIG. 3 is a schematic plan view showing another example of an array pattern of recessed portions in a sliding surface of a sliding member related to the present exemplary embodiment, and a view showing the sliding surface in a plan view.

FIGS. 2 and 3 show examples of patterns in which the central lattice points of face-centered lattices are shifted.

In a sliding member 101*a* and a sliding member 101*b* that are shown in FIGS. 2 and 3, the recessed portions 112B is dotted in the sliding surface 112A. The recessed portions 112B are required to satisfy the following two conditions.

(1) The recessed portions show an array pattern obtained by shifting some or all of points of central portions in a lattice array from the lattice array obtained by continuously arranging basic arrays including a basic lattice that is configured by four lattice points and have one side parallel to a sliding direction and a point of a central portion of the basic lattice.

(2) On the sliding surface, except both side portions thereof, at least one recessed portion is present on any straight line parallel to the sliding direction of the sliding surface. Here, the expression "recessed portion is present on all straight lines" also includes a case where a recessed portion comes into contact with a straight line.

In the above (1), the basic lattice is preferably a parallelogram. It is implied that a square, a rectangle, and a lozenge are included in the parallelogram. Although the basic lattice of the sliding member 101*a* and the sliding member 101*b* that are shown in FIGS. 2 and 3 is a square. However, the basic lattice is not limited to the square and may also be a rectangle, a lozenge, or other parallelograms.

In the above (1), "the point of the central portion of the basic lattice" means an intersection point between the diagonal lines of the basic lattice.

When the above (1) is put in another way, the recessed portions 112B show an array pattern obtained by shifting some or all of central lattice points (intersection points between diagonal lines) in face-centered lattices from a lattice array obtained by continuously arranging the face-centered lattices that have one side parallel to a sliding direction.

The central points of openings of the recessed portions are preferably located at the lattice points and the points of the central portions (of which some or all are shifted). Moreover, the shapes of the openings of the recessed portions are preferably circles having the lattice points and the points of the central portions (of which some or all are shifted) as the centers thereof.

If the above (2) is put in another way, when a straight line parallel to the sliding direction is drawn at an arbitrary position in the direction orthogonal to the sliding direction on the sliding surface, a recessed portion is certainly present on the straight line.

In addition, the sliding member may have a region, which does not come into contact with the target sliding member, at an end portion thereof in a width direction. In that case, the end portion that is a region that does not come into contact with the target sliding member is not relevant to the "sliding surface", and a recessed portion does not need to be formed at the end portion.

If the recessed portions are arranged in the sliding surface so as to satisfy the above (2), a region where there is no meeting with the openings of the recessed portions is not present in a target sliding surface of the target sliding member when the target sliding member and the sliding member slide on each other. That is, when the target sliding member and the sliding member slide on each other, all regions of the target sliding surface of the target sliding member certainly meet the openings of the recessed portions. Therefore, lubricant (oil) may be supplied to the whole target sliding surface from the recessed portions. As a result, the sliding resistance between the sliding member and the target sliding member may be suppressed over the whole sliding surface (target sliding surface).

In the related art, there is adopted a measure for increasing the area of openings of individual recessed portions in a sliding member in which recessed portions are dotted in a lattice shape or in a face-centered lattice shape in a sliding surface for the purpose of improving a lubricant (oil) supply function from the sliding member to a target sliding member or lowering the frictional coefficient of the sliding surface.

Then, since the percentage of the total area of the openings of the recessed portions in the sliding surface increases and the percentage of the area of a flat portion of the sliding surface decreases, the wear resistance degrades easily. As a result, the lifespan of the sliding member tends to become short.

Additionally, if the area of the openings of the individual recessed portions is increased, a bias may appear in the holding/supply function of lubricant in the sliding surface, and the wear coefficient may increase.

In contrast, if the array pattern is configured and the recessed portions is arranged in the sliding surface so that the above (1) and (2) are satisfied, it is not necessary to increase the area of the openings of the individual recessed portions, and accordingly, it is not necessary to increase the percentage of the total area of the openings of the recessed portions that account for in the sliding surface.

Accordingly, the sliding member 101*a* and the sliding member 101*b* may be improved in the supply function of lubricant (oil) while being excellent in the wear resistance of the sliding surface. Accordingly, the sliding member 101*a* and the sliding member 101*b* may suppress the sliding resistance between the sliding member and the target sliding member while exhibiting excellent wear resistance of the sliding surface. As a result, in the sliding member 101*a* and the sliding member 101*b*, the increase in the frictional coefficient accompanying use does not occur easily. The sliding member 101*a* and the sliding member 101*b* may be used for a prolonged period of time.

The sliding member 101*a* shown in FIG. 2 will be described.

FIG. 2 shows a lattice array obtained by continuously arranging "basic arrays including a basic lattice that is shown by four black points and has one side parallel to a sliding direction and a point (shown by a broken line) of a central portion of the basic lattice". The sliding member 101*a* has an array pattern in which the points of the central portions that configures the lattice array (shown by the broken lines) are shifted in a direction (the direction of arrows) orthogonal to the sliding direction.

This array pattern is a pattern in which the points of the central portions (shown by the broken lines) lined up on a straight line parallel to the sliding direction are alternately shifted to the left and the right, and one or more recessed portions are arranged on an arbitrary straight line parallel to the sliding direction between dotted lines. Accordingly, the arrangement of the recessed portions 112B satisfies the condition of the above (2).

The sliding member 101*b* shown in FIG. 3 will be described.

FIG. 3 also shows a lattice array obtained by continuously arranging "basic arrays including a basic lattice that is shown by four black points and has one side parallel to a sliding direction and a point (shown by a broken line) of a central portion of the basic lattice". The sliding member 101*b* has an array pattern in which the points of the central portions that configure the lattice array (shown by the broken line) are shifted in oblique directions (the directions of arrows) with respect to the sliding direction.

This array pattern is a pattern in which the points of the central portions (shown by the broken lines) lined up on a straight line parallel to the sliding direction are alternately shifted to oblique upper left and oblique upper right (oblique lower left and oblique lower right), and one or more recessed portions are arranged on an arbitrary straight line parallel to the sliding direction between dotted lines. Accordingly, the arrangement of the recessed portions 11213 satisfies the condition of the above (2).

In the sliding member 101*a* and the sliding member 101*b*, directions in which the points of the central portions (shown by the broken line) lined up on the straight line parallel to the sliding direction are shifted are not limited to the aspects shown in FIGS. 2 and 3, and are not particularly limited if one or more recessed portions are arranged on the arbitrary straight line parallel to the sliding direction between the dotted lines. That is, the directions in which the points of the central portions (shown by the broken line) lined up on the straight line parallel to the sliding direction are shifted may be regular as shown in FIGS. 2 and 3, or may be irregular. However, it is preferable that the directions be regular if the balance of the presence of the recessed portions in the sliding surface or the manufacturability is taken into consideration.

In addition, although the regular array patterns are formed within the sliding surfaces of the sliding member 101*a* and the sliding member 101*b*, a form in which some recessed portions are omitted may be adopted without impairing the effects of invention.

In the above (1), the travel distance of the points (shown by the broken lines) of the central portions may be determined according to the width of the basic lattice in the sliding direction and the diameter of the openings of the recessed portions.

For example, when the basic lattice is a parallelogram, the travel distance of the points (shown by the broken lines) of the central portions may be determined according to the distance, in the direction orthogonal to the sliding direction, between two sides parallel to the sliding direction, and the diameter of the openings of the recessed portions. Here, the expression "the diameter of the openings of the recessed portions" means the maximum diameter of the openings in the direction orthogonal to the sliding direction.

In the sliding member 101*a* and the sliding member 101*b*, the circular recessed portions of the same shape centered on the lattice points of the basic lattices are dotted, and the diameter of the openings of the recessed portions is ⅓ of the distance between two sides parallel to the sliding direction. As long as the diameter of the openings of the recessed portions is equal to or more than this, however, the travel distance between the points of the central portions for satisfying the conditions of the above (2) may be small. In this way, the circular recessed portions of the same shape centered on the lattice points of the basic lattices and the points of the central portions are dotted.

In this way, if the distance between two sides parallel to the sliding direction is equal to or less than 3 times the diameter of the openings of the recessed portions, the way of shifting the points of the central portions as in the sliding member 101*a* or the sliding member 101*b* may be simplified. Therefore, it is possible to obtain a simple array pattern. As a result, it is believed that manufacturability may be also improved.

Shape of Recessed Portions

The shape of the recessed portions 112B is not limited if the holding/supply function of lubricant (oil) may be exhibited.

The shape of the recessed portions in the planar direction include, for example, a circular shape, an elliptical shape, a triangle, a quadrangle, other polygons, or an infinite shape, and the circular shape is preferable from a viewpoint of ease of the processing of providing the recessed portions in the sliding surface.

The shape of the recessed portions in the depth direction includes, for example, a columnar shape, a cone shape, a tapered shape, or an inverted tapered shape.

The area of the opening per one recessed portions 112B is preferably from $7\times10^{-3}$ $mm^2$ to 3.2 $mm^2$, and more preferably from 0.03 $mm^2$ to 0.8 $mm^2$.

Specifically, when the shape of the recessed portions 112B in the planar direction is circular, the diameter of the openings is preferably from 100 μm to 2 mm and more preferably from 150 μm to 1 mm.

It is preferable that the percentage of the total area (the total of the area of the openings of the individual recessed portions) of the openings of the recessed portions 112B in the sliding surface be within the following range from viewpoints of being excellent in the wear resistance of the sliding surface while securing the holding/supply function of lubricant (oil).

When the array pattern of the recessed portions has the lattice shape or the face-centered lattice shape, the percentage of the total area is preferably from 10% to 60%, more preferably from 15% to 40%, and more preferably from 20% to 30%.

When the array pattern of the recessed portions is a pattern in which the central lattice points of the face-centered lattices are shifted as in the sliding member 101*a* and the sliding member 101*b* shown in FIGS. 2 and 3, the percentage of the total area is preferably from 10% to 60%, more preferably from 12% to 40%, and more preferably from 15% to 30%.

Since the recessed portions 1128 are dotted in the cyclic array from viewpoints of suppressing occurrence of pressure unevenness while securing the holding/supply function of lubricant (oil), it is preferable that the array cycle is within the above range, the distance between the adjacent recessed portions be within the above range, and the area of the opening per one recessed portion be within the above range.

The sliding member may have a region, which does not come into contact with the target sliding member, at an end portion thereof in the sliding direction or at an end portion thereof in the width direction (direction orthogonal to the sliding direction) in the surface thereof that comes into contact with the target sliding member. In that case, the end portion that is a region that does not come into contact with the target sliding member is not relevant to the "sliding surface", and a recessed portion does not need to be formed at the end portion.

Although it is preferable that the recessed portions be cyclically arranged in the sliding surface of the sliding member, some recessed portions may be omitted.

Method for Manufacturing Sliding Member

An example of a method for manufacturing of the sliding member 101A and the sliding member 101B shown in FIGS. 1A and 1B will be described.

A sheet that becomes the substrate 110, a fluororesin sheet that becomes the first fluororesin layer 112, and a fluororesin sheet that becomes the second fluororesin layer 114 are prepared.

The above respective sheets are laminated with a fluorine-based adhesive sheet therebetween, and a five-layer laminate (the fluororesin sheet that becomes the first fluororesin layer 112/the fluorine-based adhesive sheet/the sheet that becomes substrate 110/the fluorine-based adhesive sheet/the fluororesin sheet that becomes the second fluororesin layer 114).

Then, by applying pressure and heat from above and below the laminate, the fluororesin sheet that becomes the first fluororesin layer 112 and the sheet that becomes the substrate 110 are pasted together and the sheet that becomes the substrate 110 and the fluororesin sheet that becomes the second fluororesin layer 114 are pasted together. The pressure applied to the laminate when being pasted together is, for example, from 1.0 MPa to 2.0 MPa, and the heating temperature is, for example, from 320° C. to 350° C.

Next, the recessed portions 112B are formed by the following method.

First, a die having convex portions on a pressing surface is prepared.

Then, the die is pressed against the fluororesin sheet that becomes the first fluororesin layer 112 to heat the fluororesin sheet to the glass transition temperature of the fluororesin or higher, and recessed portions or through holes corresponding to the convex portions are formed in the fluororesin sheet that becomes the first fluororesin layer 112.

The convex portions of the pressing surface of the die may be made by an NC machine tool or the like or may be made by etching.

Otherwise, the convex portions may be made by nickel electrocasting or may be made by a method (electroforming method) in which nickel electrocasting and photolithography are combined. These methods are advantageous in terms of high precision or the ease of duplication.

Fixing Device

The fixing device related to the present exemplary embodiment includes a first rotary member; a second rotary member that is arranged in contact with an external surface of the first rotary member; a pressing member that is arranged inside the second rotary member and presses the second rotary member against the first rotary member from an inner surface of the second rotary member; and the sliding member related to the present exemplary embodiment that is interposed between the inner surface of the second rotary member and the pressing member.

The fixing device related to the present exemplary embodiment preferably also includes a heating source that heats at least one of the first rotary member and the second rotary member.

The surface roughness Ra of an inner surface (inner circumferential surface) of a heating belt or a pressure belt as an example of the second rotary member is preferably from 0.1 μm to 2.0 μm and more preferably from 0.3 μm to 1.5 μm. If the surface roughness is within the above range, the sliding resistance between the heating belt or pressure belt as an example of the second rotary member and the sliding member decreases, and when lubricant (oil) is interposed, the lubricant (oil) is easily held between both of the members and the wear resistance of the sliding member improves.

Here, the measurement of the surface roughness Ra is performed under the measurement conditions that evaluation length Ln is 4 mm, reference length L is 0.8 mm, and cut-off value is 0.8 mm, in conformity with JIS B0601-1994, using a surface roughness meter SURFCOM 1400A (made by Tokyo Seimitsu Co., Ltd.)

Although there are various configurations as the fixing device related to the present exemplary embodiment, the following two exemplary embodiments will be specifically described.

As a first exemplary embodiment, fixing device including a heating roll having a heating source and a pressure belt against which a pressing pad is pressed will be described.

As a second exemplary embodiment, a fixing device including a heating belt having a heating source and having a pressing pad pressed thereagainst, and a pressure roll will be described.

As a sheet-like sliding member in these fixing devices, the sliding member related to the present exemplary embodiment is applied.

First Exemplary Embodiment of Fixing Device

A fixing device 60 related to the first exemplary embodiment will be described with reference to FIG. 4.

Figure 4:
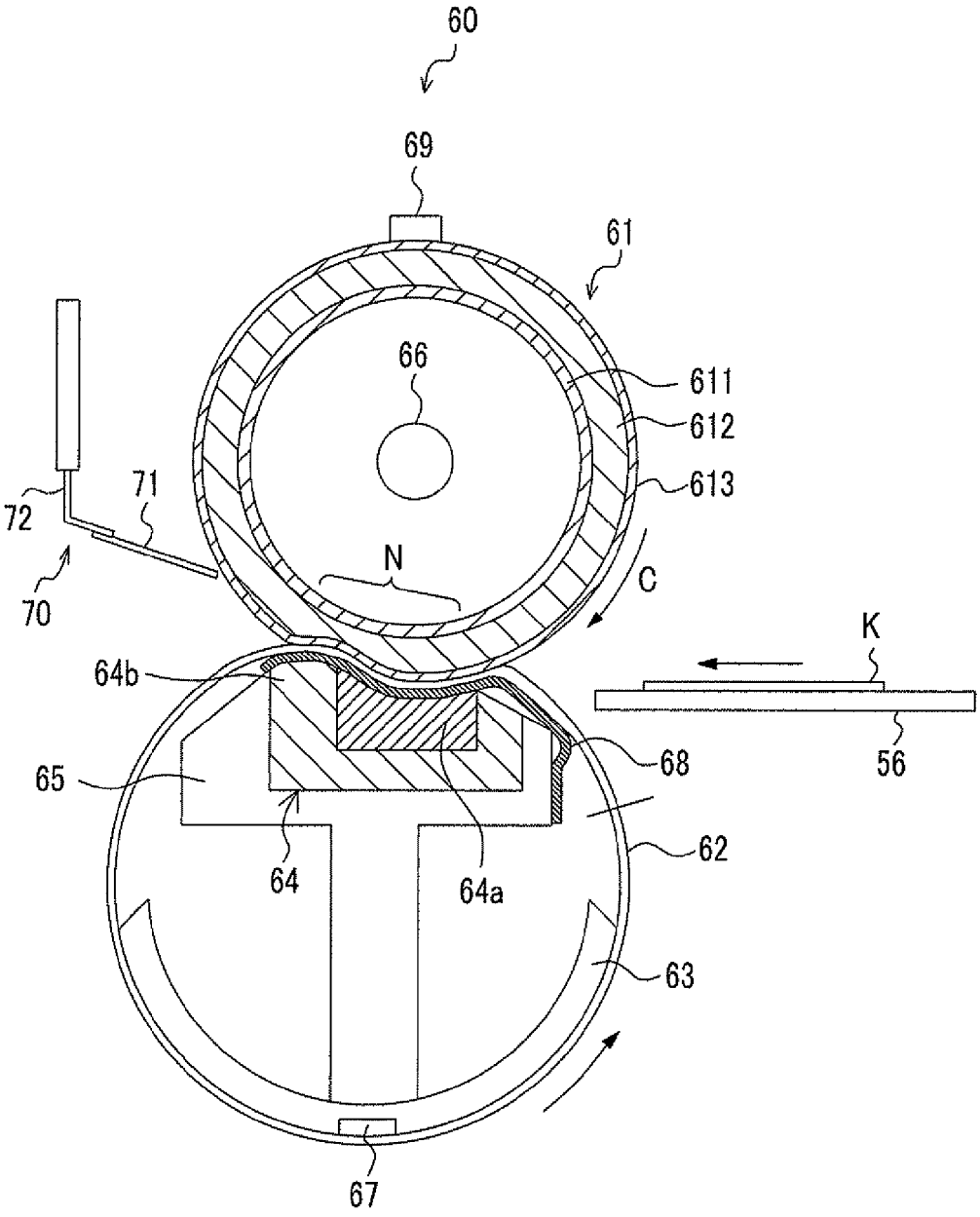
FIG. 4 is a schematic view showing a configuration example of a fixing device of a first exemplary embodiment.

FIG. 4 is a schematic view showing the configuration of the fixing device 60 related to the first exemplary embodiment.

The fixing device 60 includes a heating roll 61 (an example of the first rotary member), a pressure belt 62 (an example of the second rotary member), a pressing pad 64 (an example of the pressing member), a sliding member 68 (an example of the sliding member related to the present exemplary embodiment), and a halogen lamp 66 (an example of the heating source).

The heating roll 61 and the pressure belt 62 come into contact with each other at outer circumferential surfaces thereof, and apply a pressure to each other. The pressure belt 62 may be pressed against the heating roll 61, or the heating roll 61 may be pressed against the pressure belt 62. A pinching region N (nip portion) is formed in a region where the heating roll 61 and the pressure belt 62 come into contact with each other.

The heating roll 61 has the halogen lamp 66 (an example of the heating source) therein. The heating source is not limited to the halogen lamp and may be other heat-generating members that generate heat.

A temperature-sensitive element 69 is arranged in contact with the outer circumferential surface of the heating roll 61. On the basis of a temperature measurement value measured by the temperature-sensitive element 69, turn-on of the halogen lamp 66 is controlled and the surface temperature of the heating roll 61 is maintained at a set temperature (for example, 150° C.).

The heating roll 61 is configured, for example, by laminating a heat-resistant elastomer layer 612 and a release layer 613 around a metallic core (cylindrical core) 611 in this order.

The pressure belt 62 is arranged in contact with the outer circumferential surface of the heating roll 61.

The pressure belt 62 is rotatably supported by the pressing pad 64 and a belt traveling guide 63 that are arranged therein.

The pressing pad 64 is arranged inside the pressure belt 62, and applies a pressure to the heating roll 61 via the pressure belt 62.

The pressing pad 64 includes a front pinching member 64*a* on the inlet side of the pinching region N and includes a separation pinching member 64*b* on the outlet side of the pinching region N.

The front pinching member 64*a* is configured in a recessed shape along the outer circumferential shape of the heating roll 61, and secures the length (distance in the sliding direction) of the pinching region N.

The separation pinching member 64*b* is configured in a shape that protrudes with respect to the outer circumferential surface of the heating roll 61, causes local distortion in the heating roll 61 in an outlet region of the pinching region N, and facilitates separation of a recording medium after fixing from the heating roll 61.

The sliding member 68 is configured in a sheet shape, and is arranged such that a sliding surface (surface dotted with the recessed portions) thereof comes into contact with the inner circumferential surface of the pressure belt 62 between the pressure belt 62 and the pressing pad 64.

The sliding member 68 participates in holding and supplying of lubricant (oil) that is present between the sliding surface and the inner circumferential surface of the pressure belt 62. The sliding member 68 is excellent in wear resistance, and the long lifespan of the fixing device 60 is attained.

The sliding member 68 is arranged so as to cover the front pinching member 64*a* and the separation pinching member 64*b* in order to reduce the sliding resistance between the inner circumferential surface of the pressure belt 62 and the pressing pad 64.

A holding member 65 holds the pressing pad 64 and the sliding member 68. The holding member 65 is made of, for example, metal.

The belt traveling guide 63 is attached to the holding member 65. The pressure belt 62 rotates along the belt traveling guide 63.

A lubricant supply device 67, which is a unit that supplies lubricant (oil) to the inner circumferential surface of the pressure belt 62, may be attached to the belt traveling guide 63.

A separation member 70 as an auxiliary unit for separation of a recording medium is provided on the downstream side of the pinching region N. The separation member 70 includes a separation claw 71 and a holding member 72 holding the separation claw 71. The separation claw 71 is arranged in proximity to the heating roll 61 in a direction (counter direction) facing in the rotational direction of the heating roll 61.

The heating roll 61 rotates in the direction of arrow C by a drive motor (not shown), and the pressure belt 62 rotates in a direction opposite to the rotational direction of the heating roll 61 so as to follow this rotation.

A sheet K (recording medium) that has an unfixed toner image is guided by the fixing entry guide 56 and is transported to the pinching region N. When the sheet K passes through the pinching region N, the toner image on the sheet K is fixed by the pressure and heat that act on the pinching region N.

Second Exemplary Embodiment of Fixing Device

A fixing device 80 related to the second exemplary embodiment will be described with reference to FIG. 5.

Figure 5:
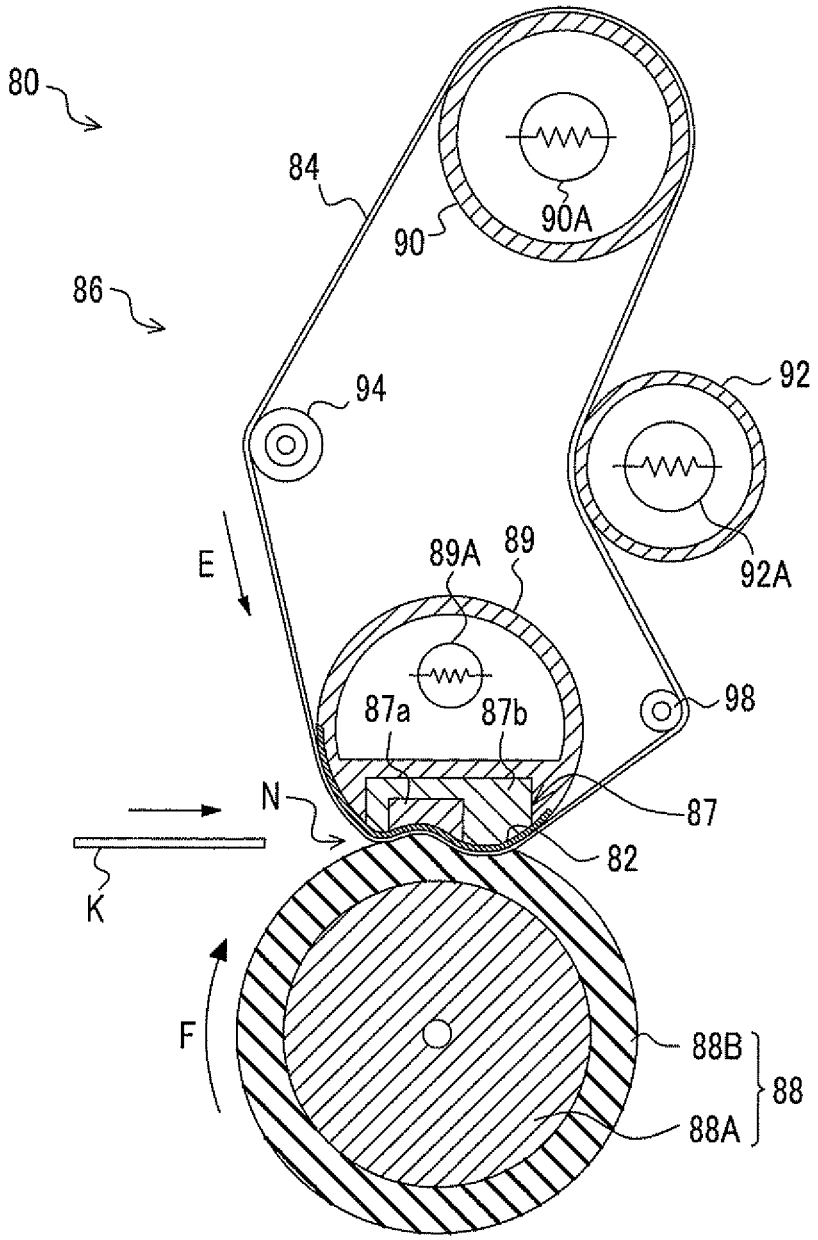
FIG. 5 is a schematic view showing a configuration example of a fixing device of a second exemplary embodiment.

FIG. 5 is a schematic view showing the configuration of the fixing device 80 related to the second exemplary embodiment.

The fixing device 80 includes a pressure roll 88 (an example of the first rotary member) and a fixing belt module 86.

The fixing belt module 86 includes a heating belt 84 (an example of the second rotary member), a pressing pad 87 (an example of the pressing member), a sliding member 82 (an example of the sliding member related to the present exemplary embodiment), and a halogen heater 89A (an example of the heating source) that is disposed in the vicinity of the pressing pad 87.

Moreover, the fixing belt module 86 includes a support roller 90, a support roller 92, a posture correction roll 94, and a support roller 98.

The pressure roll 88 is arranged so as to be pressed against the heating belt 84 (fixing belt module 86), and a pinching region N (nip portion) is formed in a region where the pressure roll 88 and the heating belt 84 (fixing belt module 86) come into contact with each other.

The heating belt 84 is configured in an endless shape, and is rotatably supported by the pressing pad 87 and the support roller 90 that are arranged therein.

The heating belt 84 is wound around the pressing pad 87, and the heating belt 84 is pressed against the pressure roll 88.

The pressing pad 87 includes a front pinching member 87*a* and a separation pinching member 87*b* and is supported by a holding member 89.

The front pinching member 87*a* is configured in a recessed shape along the outer circumferential shape of the pressure roll 88, is arranged on the inlet side of the pinching region N, and secures the length (distance in the sliding direction) of the pinching region N.

The separation pinching member 87*b* is configured in a shape that protrudes with respect to the outer circumferential surface of the pressure roll 88, is arranged on the outlet side of the pinching region N, causes local distortion in the pressure roll 88 in an outlet region of the pinching region N, and facilitates separation of a recording medium after fixing from the pressure roll 88.

The pressing pad 87 includes the halogen heater 89A (an example of the heating source) in the vicinity (for example, inside the holding member 89) of the heating pad and heats the heating belt 84 from the inner circumferential surface side.

A lubricant supply device (not shown), which is a unit that supply lubricant (oil) to the inner circumferential surface of the heating belt 84, may be attached, for example, upstream of the front pinching member 87*a* of the holding member 89.

The sliding member 82 is configured in a sheet shape, and is arranged such that a sliding surface (surface dotted with the recessed portions) thereof comes into contact with the inner circumferential surface of the heating belt 84 between the heating belt 84 and the pressing pad 87.

The sliding member 82 participates in holding and supplying of lubricant (oil) that is present between the sliding surface and the inner circumferential surface of the heating belt 84. The sliding member 82 is excellent in wear resistance, and the long lifespan of the fixing device 80 is attained.

The support roller 90 has the heating belt 84 wound therearound, and supports the heating belt 84 at a position different from the pressing pad 87.

The support roller 90 includes a halogen heater 90A (an example of the heating source) therein and heats the heating belt 84 from the inner circumferential surface side.

The support roller 90 is a roller in which a release layer made of the fluororesin with a thickness of, for example, 20 μm, is formed on an outer circumferential surface of a cylindrical roll made of, for example, aluminum.

The support roller 92 is arranged in contact with an outer circumferential surface of the heating belt 84 ranging from the pressing pad 87 to the support roller 90, and defines the circling path of the heating belt 84.

The support roller 92 includes a halogen heater 92A (an example of the heating source) therein and heats the heating belt 84 from the outer circumferential surface side.

The support roller 92 is a roller in which a release layer made of the fluororesin with a thickness of, for example, 20 μm, is formed on an outer circumferential surface of a cylindrical roll made of, for example, aluminum.

At least one of the halogen heater 89A, the halogen heater 90A, and the halogen heater 92A that are examples of the heating source may be included.

The posture correction roll 94 is arranged in contact with the inner circumferential surface of the heating belt 84 ranging from the support roller 90 to the pressing pad 87, and corrects the posture of the heating belt 84 ranging from the support roller 90 to the pressing pad 87.

An end portion position measurement mechanism (not shown) that measures the end portion position of the heating belt 84 is arranged in the vicinity of the posture correction roll 94, an axial displacement mechanism (not shown) that displaces a abutting position in an axial direction of the heating belt 84 according to the measurement result of the end portion position measurement mechanism is disposed at the posture correction roll 94, and these mechanisms correct the posture of the heating belt 84.

The posture correction roll 94 is a columnar roll of, for example, aluminum.

The support roller 98 is arranged in contact with the inner circumferential surface of the heating belt 84 ranging from the pressing pad 87 to the support roller 92, and imparts tension from the inner circumferential surface of the heating belt 84 to the heating belt 84 on the downstream side of the pinching region N.

The support roller 98 is a roller in which a release layer made of the fluororesin with a thickness of, for example, 20 μm, is formed on an outer circumferential surface of a cylindrical roll made of, for example, aluminum.

The pressure roll 88 is arranged so as to be pressed against the heating belt 84 in a portion where the heating belt 84 is wound around the pressing pad 87.

The pressure roll 88 is rotatably provided, and rotates in the direction of arrow F so as to follow the heating belt 84 as the heating belt 84 rotationally moves in the direction of arrow E.

The pressure roll 88 is configured such that an elastic layer 88B made of, for example, silicone rubber and a separation layer (not shown) made of, for example, a fluororesin with a thickness of 100 μm are laminated in this order on an outer circumferential surface of a columnar roll 88A of, for example, aluminum.

For example, the support roller 90 or the support roller 92 is rotated by a drive motor (not shown), the heating belt 84 rotationally moves in the direction of arrow E so as to follow this rotation, and the pressure roll 88 rotates in the direction of arrow F so as to follow the rotational movement of the heating belt 84.

A sheet K (recording medium) that has an unfixed toner image is transported to the pinching region N of the fixing device 80. When the sheet K passes through the pinching region N, the toner image on the sheet K is fixed by the pressure and heat that act on the pinching region N.

Image Forming Apparatus

The image forming apparatus related to the present exemplary embodiment includes an image holding member, a charging device that charges the surface of the image holding member, a latent image forming device that forms a latent image on the charged surface of the image holding member, a developing device that develops the latent image with toner to form a toner image, a transfer device that transfers the toner image to a recording medium, and the fixing device applied to the present exemplary embodiment that fixes the toner image on the recording medium.

An electrophotographic image forming apparatus that is an example will be described regarding the image forming apparatus related to the present exemplary embodiment. The image forming apparatus related to the present exemplary embodiment is not limited to the electrophotographic image forming apparatus, and may be well-known image forming apparatuses (for example, an ink jet recording device or the like including an endless belt for transporting a sheet) other than electrophotography.

The image forming apparatus related to the present exemplary embodiment will be described with reference to FIG. 6.

Figure 6:
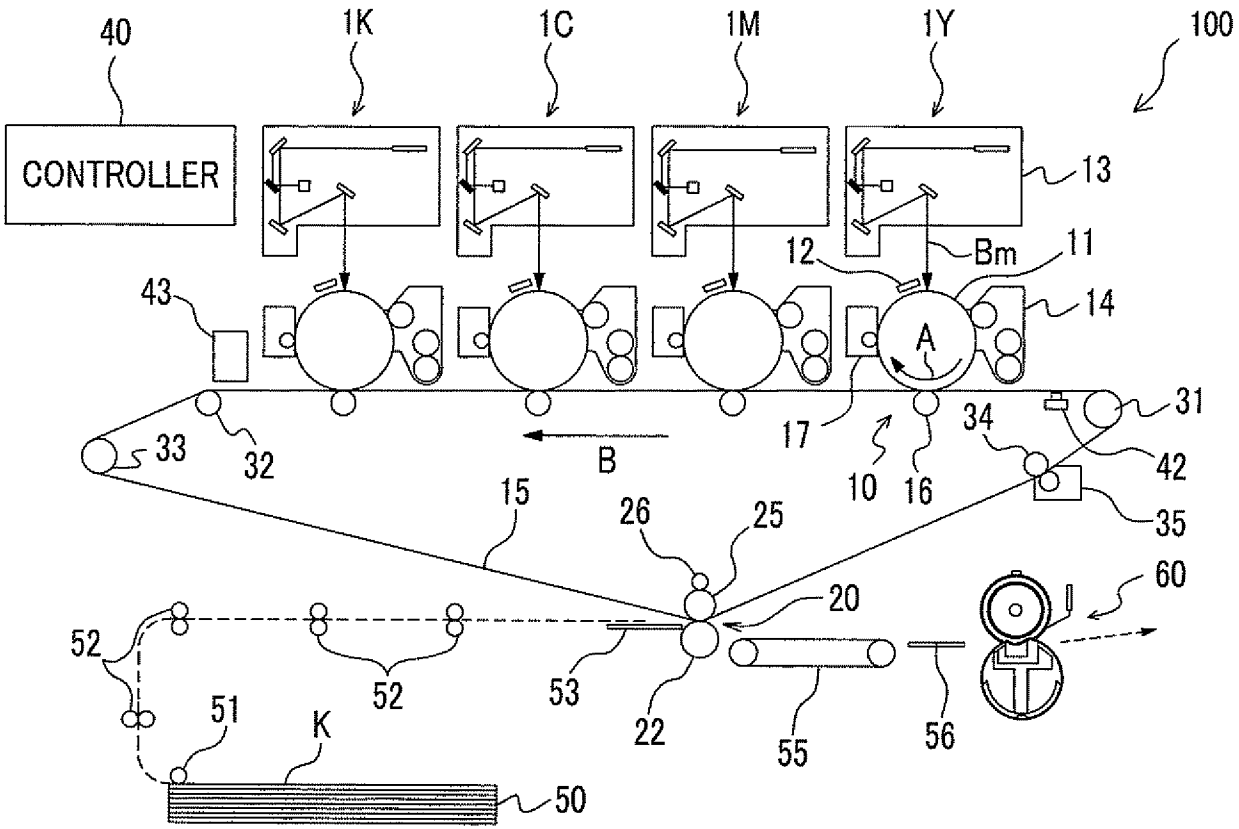
FIG. 6 is a schematic view showing a configuration example of an image forming apparatus related to the present exemplary embodiment.

FIG. 6 is a schematic view showing the configuration of an image forming apparatus 100 related to the present exemplary embodiment. The image forming apparatus 100 includes the fixing device 60 of the aforementioned first exemplary embodiment. The image forming apparatus 100 may include the fixing device 80 related to the aforementioned second exemplary embodiment instead of the fixing device 60.

The image forming apparatus 100 is an intermediate transfer type image forming apparatus generally referred to as a tandem type. The image forming apparatus 100 includes image forming units 1Y, 1M, 1C, and 1K where toner images in respective colors are formed by electrophotography, a primary transfer portion 10 that sequentially transfers (primarily transfers) the toner images in the respective colors formed to an intermediate transfer belt 15, a secondary transfer portion 20 that collectively transfers (secondarily transfers) superimposed toner images transferred onto the intermediate transfer belt 15 to a sheet K that is a recording medium, and a fixing device 60 that fixes the secondarily transferred image on the sheet K, and a controller 40 that controls the operation of the respective devices (respective portions).

The image forming units 1Y, 1M, 1C, and 1K are arranged substantially linearly in order of 1Y (unit for yellow), 1M (unit for magenta), 1C (unit for cyan), and 1K (unit for black) from the upstream side of the intermediate transfer belt 15.

The image forming units 1Y, 1M, 1C, and 1K include a photoconductor 11 (an example of the image holding member), respectively. The photoconductor 11 rotates in the direction of arrow A.

A charger 12 (an example of the charging device), a laser exposure unit 13 (an example of the latent image forming device), a developer unit 14 (an example of the developing device), a primary transfer roll 16, and a photoconductor cleaner 17 are sequentially disposed along the rotational direction of the photoconductor 11 around the photoconductor 11.

The charger 12 charges the surface of the photoconductor 11.

The laser exposure unit 13 emits an exposure beam Bm to form an electrostatic latent image on the photoconductor 11.

The developer unit 14 contains each color toner, and forms the electrostatic latent image on the photoconductor 11 as a visible image with toner.

The primary transfer roll 16 transfers the toner image formed on the photoconductor 11 to the intermediate transfer belt 15 in the primary transfer portion 10.

The photoconductor cleaner 17 removes residual toner on the photoconductor 11.

The intermediate transfer belt 15 is a belt made of a material obtained by adding antistatic agents, such as carbon black, to a resin, such as polyimide or polyimide. The intermediate transfer belt 15 is, for example, from $10^6$ Ωcm to $10^{14}$ Ωcm in volume resistivity, and is, for example, 0.1 mm in thickness.

The intermediate transfer belt 15 is supported by a drive roll 31, a support roller 32, a tension imparting roll 33, a rear surface roll 25, and a cleaning rear surface roll 34, and is circularly driven (rotated) in the direction of arrow B according to the rotation of the drive roll 31.

The drive roll 31 is driven by a motor (not shown) having an excellent constant speed property to rotate the intermediate transfer belt 15.

The support roller 32 supports the intermediate transfer belt 15 that extends substantially linearly along an array direction of four photoconductors 11 together with the drive roll 31.

The tension imparting roll 33 functions as a correction roll that imparts constant tension to the intermediate transfer belt 15 and suppresses meandering of the intermediate transfer belt 15.

The rear surface roll 25 is provided at the secondary transfer portion 20, and the cleaning rear surface roll 34 is provided at a cleaning portion that scrapes off the residual toner on the intermediate transfer belt 15.

The primary transfer roll 16 is arranged in pressure contact with the photoconductor 11 across the intermediate transfer belt 15, and forms the primary transfer portion 10.

A voltage (primary transfer bias) having a polarity reverse to the charging polarity (made into a negative polarity; the same applies below) of toner is applied to the primary transfer roll 16. Accordingly, the toner images on the respective photoconductors 11 are sequentially and electrostatically attracted to the intermediate transfer belt 15, and superimposed toner images are formed on the intermediate transfer belt 15.

The primary transfer roll 16 is a cylinder roll configured by a shaft (for example, a columnar rod of metals, such as iron and SUS), and an elastic layer (for example, a sponge layer of blend rubber in which conductive agents, such as carbon black, are blended) that is anchored around the shaft. The volume resistivity of the primary transfer roll 16 is, for example, from $10^{7.5}$ Ωcm to $10^{8.5}$ Ωcm.

The secondary transfer roll 22 is arranged in pressure contact with the rear surface roll 25 across the intermediate transfer belt 15, and forms the secondary transfer portion 20.

The secondary transfer roll 22 forms a secondary transfer bias between the secondary transfer roll and the rear surface roll 25, and secondarily transfers the toner image onto a sheet K (recording medium) transported to the secondary transfer portion 20.

The secondary transfer roll 22 is a cylinder roll configured by a shaft (for example, a columnar rod of metals, such as iron and SUS), and an elastic layer (for example, a sponge layer of blend rubber in which conductive agents, such as carbon black, are blended) that is anchored around the shaft. The volume resistivity of the secondary transfer roll 22 is, for example, from $10^{7.5}$ Ωcm to $10^{8.5}$ Ωcm.

The rear surface roll 25 is arranged on the back side of the intermediate transfer belt 15, configures a counter electrode of the secondary transfer roll 22, and forms a transfer electric field between the rear surface and the secondary transfer rolls 22.

The rear surface roll 25 is configured, for example, by covering a rubber base material with a tube of blend rubber in which carbon is dispersed. For example, the surface resistivity of the rear surface roll 25 is, for example, from $10^7\Omega/\square$ to $10^{10}\Omega/\square$, and the harness of the rear surface roll is, for example, from 70° (Anka C made by Kobunshi Keiki Co., LTD.; the same applies below).

A metallic power feed roll 26 is arranged in contact with the rear surface roll 25. The power feed roll 26 applies a voltage (secondary transfer bias) of the same polarity as the charging polarity (negative polarity) of toner, and forms a transfer electric field between the secondary transfer roll 22 and the rear surface roll 25.

An intermediate transfer belt cleaner 35 is provided on the downstream side of the secondary transfer portion 20 of the intermediate transfer belt 15 so as to be brought into contact with or separated from the intermediate transfer belt 15. The intermediate transfer belt cleaner 35 removes residual toner or paper debris on the intermediate transfer belt 15 after the secondary transfer.

A reference sensor (home-position sensor) 42 is disposed on the upstream side of the image forming unit 1Y. The reference sensor 42 generates a reference signal that becomes a reference for taking image formation timing in each image forming unit. The reference sensor 42 recognizes a mark provided on the back side of the intermediate transfer belt 15 to generate a reference signal, and the image forming units 1Y, 1M, 1C, and 1K start image formation according to instructions from the controller 40 that has recognized this reference signal.

An image density sensor 43 for performing adjustment of image quality is disposed on the downstream side of the image forming unit 1K.

The image forming apparatus 100 includes a sheet accommodating section 50, a sheet feed roll 51, a transport roll 52, a transportation guide 53, a transport belt 55, and a fixing entry guide 56, as a transport unit that transports a sheet K.

The sheet accommodating section 50 accommodates sheets K before image formation.

The sheet feed roll 51 takes out a sheet K accommodated in the sheet accommodating section 50.

The transport roll 52 transports the sheet K taken out by the sheet feed roll 51.

The transportation guide 53 sends the sheet K transported by the transport roll 52 into the secondary transfer portion 20.

The transport belt 55 transports the sheet K, to which an image is transferred in the secondary transfer portion 20, to the fixing device 60.

The fixing entry guide 56 guides the sheet K to the fixing device 60.

Next, an image forming method using the image forming apparatus 100 will be described.

In the image forming apparatus 100, image data output from an image reader (not shown), a computer (not shown), or the like is subjected to image processing by an image processor (not shown), and image forming work is executed by the image forming units 1Y, 1M, 1C, and 1K.

In the image processor, image processing, such as shading correction, positional deviation correction, brightness/color space conversion, gamma correction, frame erasing, color editing, and movement editing, is performed on input reflectivity data. The image data subjected to the image processing is converted into color material gradation data of four colors of Y, M, C, and K, and is output to the laser exposure unit 13.

In the laser exposure unit 13, the photoconductor 11 of each of the image forming units 1Y, 1M, 1C, and 1K is irradiated with an exposure beam Bm according to the input color material gradation data.

In the photoconductor 11 of each of the image forming units 1Y, 1M, 1C, and 1K, the surface of the photoconductor is charged by the charger 12, and then, the surface is scanned and exposed by the laser exposure unit 13 to form an electrostatic latent image. The electrostatic latent image formed on each photoconductor 11 is developed as each color toner image by each image forming unit.

The toner image formed on the photoconductor 11 of each of the image forming units 1Y, 1M, 10, and 1K is transferred onto the intermediate transfer belt 15 in the primary transfer portion 10 where each photoconductor 11 and the intermediate transfer belt 15 come into contact with each other. In the primary transfer portion 10, a voltage (primary transfer bias) having a polarity reverse to the charging polarity (negative polarity) of toner is added to the intermediate transfer belt 15 by the primary transfer roll 16, and the toner images are sequentially superimposed and transferred onto the intermediate transfer belt 15.

The toner images primarily transferred onto the intermediate transfer belt 15 are transported to the secondary transfer portion 20 as the intermediate transfer belt 15 moves.

A sheet K accommodated in the sheet accommodating section 50 is transported by the sheet feed roll 51, the transport roll 52, and the transportation guide 53 in conformity with the timing at which the toner images reach the secondary transfer portion 20, is supplied to the secondary transfer portion 20, and is pinched between the intermediate transfer belt 15 and the secondary transfer roll 22.

Then, in the secondary transfer portion 20 in which a transfer electric field is formed, the toner images on the intermediate transfer belt 15 are electrostatically transferred (secondarily transferred) onto the sheet K.

The sheet K onto which the toner images are electrostatically transferred is separated from the intermediate transfer belt 15 by the secondary transfer roll 22, and is transported up to the fixing device 60 by the transport belt 55.

The sheet K transported to the fixing device 60 is heated and pressurized by the fixing device 60, and the unfixed toner images are fixed.

An image is formed on a recording medium through the above processes by the image forming apparatus 100.

EXAMPLES

Although the present exemplary embodiments will be specifically described below through Examples, the present exemplary embodiments are not limited only to the following Examples.

Preparation of Die

A die (SUS plate by Hitachi Maxell, Ltd.) with a column made by nickel electroforming that has a region (50 mm×400 mm) dotted with straight columnar convex portions on a pressing surface is made by electro fine forming.

As the die, five types of Dies (1) to (5) are made. The shapes and array patterns of the convex portions of the respective dies are shown in Table 1.

The array pattern of Die (4) is a pattern in which the central lattice points of square face-centered lattices (array pitch of 0.75 mm) are shifted by 0.125 mm in a direction orthogonal to the sliding direction.

The array pattern of Die (5) is a pattern in which the central lattice points of square face-centered lattices (array pitch of 0.75 mm) are shifted by 0.125 mm in an oblique direction with respect to a sliding direction (distance in a direction orthogonal to the sliding direction).

TABLE 1

| | Diameter of convex portion | Height of convex portion | Array pattern of convex portion | Array pitch |
|---|---|---|---|---|
| Die (1) | 0.2 mm | 0.1 mm | Square lattice pattern | 0.6 mm |
| Die (2) | 0.25 mm | 0.1 mm | Square lattice pattern | 0.6 mm |
| Die (3) | 0.25 mm | 0.1 mm | Square Face-centered lattice pattern | 0.75 mm |
| Die (4) | 0.25 mm | 0.1 mm | Pattern in which central lattice points of square face-centered lattices are shifted | 0.75 mm |
| Die (5) | 0.25 mm | 0.1 mm | Pattern in which central lattice points of square face-centered lattices are shifted | 0.75 mm |

The area percentages (the percentage of the total areas of the opening portions of the recessed portions in the sliding surfaces) of the recessed portions formed in the sliding surfaces according to Dies (1) to (5) are Die (1): 8.7%, Die (2): 13.6%, and Dies (3) to (5): 17.4% in terms of calculation.

However, since the diameter of the recessed portions becomes larger than the diameter of the convex portions of the dies when forming the recessed portions in the sliding surfaces, practically, the area percentage of the recessed portions formed in the sliding surfaces are Die (1): 13%, Die (2): 19%, and Dies (3) to (5): 25%.

Example 1

Making of Laminated Sheet

The following materials are prepared.

Polyimide resin sheet: 75 μm in thickness and 80 mm×400 mm

Bridged PTFE sheet (Excellon XF-1B made by Hitachi Cable, Ltd.): 100 μm in thickness and 80 mm×400 mm Unbridged PTFE sheet (Naflon sheet by NICHIAS CORP. (registered trademark)): 100 μm in thickness and 80 mm×400 mm Adhesive fluororesin sheet (Silky Bond made by Junkosha Inc.): 20 μm in thickness A laminate is made by laminating the bridged PTFE sheet, the polyimide resin sheet, and the unbridged PTFE sheet in this order via the adhesive fluororesin sheet. This laminate is pasted together by being heated and pressurized (1 MPa/320° C./10 minutes), and a laminated sheet is obtained.

Formation of Recessed Portion

Die (1) is superimposed on the bridged PTFE sheet side of the laminated sheet. In this case, the direction of sides of 400 mm of the sheet and the direction of sides of 400 mm of Die (1) are made to coincide with each other, and sides of 50 mm of Die (1) are superimposed on the center of sides of 80 mm of the sheet.

Then, recessed portions are formed by pressurizing Die (1) with a pressing machine while heating Die (1) at 180° C.

Through the above processing, a sliding member of three-layer structure in which the recessed portions are dotted in the shape of a lattice in a sliding surface is obtained.

Example 2

Making of Laminated Sheet

A laminated sheet is made similar to Example 1.

Formation of Recessed Portion

Recessed portions are formed on the bridged PTFE sheet side of the laminated sheet by using Die (2), similar to Example 1.

Through the above processing, a sliding member of three-layer structure in which the recessed portions are dotted in the shape of a lattice in a sliding surface is obtained.

Example 3

Making of Laminated Sheet

A laminated sheet is made similar to Example 1 except that an unbridged PTFE sheet (Naflon sheet by NICHIAS CORP. (registered trademark)) with a thickness of 50 μm is used instead of the unbridged PTFE sheet with a thickness of 100 μm.

Formation of Recessed Portion

Recessed portions are formed on the bridged PTFE sheet side of the laminated sheet by using Die (2), similar to Example 1.

Through the above processing, a sliding member of three-layer structure in which the recessed portions are dotted in the shape of a lattice in a sliding surface is obtained.

Example 4

Making of Laminated Sheet

A laminated sheet is made similar to Example 1 except that an unbridged PTFE sheet (Naflon sheet by NICHIAS CORP. (registered trademark)) with a thickness of 200 μm is used instead of the unbridged PTFE sheet with a thickness of 100 μm.

Formation of Recessed Portion

Recessed portions are formed on the bridged PTFE sheet side of the laminated sheet by using Die (2), similar to Example 1.

Through the above processing, a sliding member of three-layer structure in which the recessed portions are dotted in the shape of a lattice in a sliding surface is obtained.

Comparative Example 1

Making of Laminated Sheet

A laminated sheet is made similar to Example 1 except for not using the unbridged PTFE sheet.

Formation of Recessed Portion

Recessed portions are formed on the bridged PTFE sheet side of the laminated sheet by using Die (2), similar to Example 1.

Through the above processing, a sliding member of two-layer structure in which the recessed portions are dotted in the shape of a lattice in a sliding surface is obtained.

Comparative Example 2

Making of Laminated Sheet

A laminated sheet is made similar to Example 1 except that a polyimide resin sheet (Kafton sheet made by Du Pont-Toray Co. Ltd. (registered trademark), 100 μm in thickness, and 80 mm×400 mm) is used instead of the unbridged PTFE sheet.

Formation of Recessed Portion

Recessed portions are formed on the bridged PTFE sheet side of the laminated sheet by using Die (2), similar to Example 1.

Through the above processing, a sliding member of three-layer structure in which the recessed portions are dotted in the shape of a lattice in a sliding surface is obtained.

Example 5

Making of Laminated Sheet

A laminated sheet is made similar to Example 1.

Formation of Recessed Portion

Recessed portions are formed on the bridged PTFE sheet side of the laminated sheet by using Die (3), similar to Example 1.

Through the above processing, a sliding member of three-layer structure in which the recessed portions are dotted in the shape of a face-centered lattice in a sliding surface is obtained.

Example 6

Making of Laminated Sheet

A laminated sheet is made similar to Example 1.

Formation of Recessed Portion

Recessed portions are formed on the bridged PTFE sheet side of the laminated sheet by using Die (4), similar to Example 1.

Through the above processing, a sliding member of three-layer structure in which the recessed portions are dotted in a pattern in which the central lattice points of face-centered lattices are shifted in a sliding surface is obtained.

Example 7

Making of Laminated Sheet

A laminated sheet is made similar to Example 1.

Formation of Recessed Portion

Recessed portions are formed on the bridged PTFE sheet side of the laminated sheet by using Die (5), similar to Example 1.

Through the above processing, a sliding member of three-layer structure in which the recessed portions are dotted in a pattern in which the central lattice points of face-centered lattices in a sliding surface are shifted is obtained.

Evaluation

Deformation of Sliding Member

The sliding members of Comparative Example 1 and Comparative Example 2 are wound in a tubular shape with the sliding surfaces being disposed on the inner side. Therefore, the sliding members of Comparative Example 1 and Comparative Example 2 are not easily attached to the fixing device.

In the sliding members of Examples 1, 2, 5 to 7, deformation, such as deflection, bending, or winding is not recognized in visual observation.

In the sliding member of Example 3, deflection is slightly recognized with the sliding surface being disposed on the inner side. However, difficulty does not occur in the attachment to the fixing device.

In the sliding member of Example 4, deflection is slightly recognized with the sliding surface being disposed on the outer side. However, difficulty does not occur in the attachment to the fixing device.

Frictional Coefficient of Sliding Member

As an evaluation machine, Color1000 Press made by Fuji Xerox Co. Ltd. including a belt roll nip type fixing device is prepared.

The fixing device of this evaluation machine is configured as in the fixing device 80 shown in FIG. 5, and the surface roughness Ra of the inner circumferential surface of the heating belt (target sliding member; the heating belt 84 in FIG. 5) is 0.8 μm.

The sliding members of the respective Examples and Comparative Examples are attached to the fixing device of the evaluation machine, and this evaluation machine are continuously operated at a process speed of 800 mm/sec under the environment of 22° C. and 55 RH %.

The frictional coefficient (initial frictional coefficient) between the sliding members and the heating belt when operation starts and the frictional coefficient (frictional coefficient after sheet pass) when 1,200,000 sheets (1200 kpv) have passed is measured. A torque monitor capable of always performing monitoring is used for measurement to measure system torque to obtain system frictional coefficients, and the system frictional coefficients are used instead of the frictional coefficients. Measurement results are shown in Table 2.

Wear Amount of Sliding Member

The sliding members (sliding members when 1200 kpv have passed) after the above evaluation is performed are removed from the fixing device, and the thicknesses thereof is measured using an eddy current type thickness measurement apparatus (made by the Fischer Instruments K.K.).

The measurement is performed at five arbitrary points at a flat portion of a nip region. The difference (μm) between the average value of the five points and a thickness measured in advance before use is obtained, and is adopted as the wear amount. Measurement results are shown in Table 2.

TABLE 2

| | Layer configuration (Thickness) | Array pattern of recessed portion | Initial frictional coefficient | Frictional coefficient after sheet pass | Wear Amount |
|---|---|---|---|---|---|
| Example 1 | Bridged PTFE (100 μm)/ Polyimide resin (75 μm)/ Unbridged PTFE (100 μm) | Lattice pattern | 0.08 | 0.1 | 12 μm |
| Example 2 | Bridged PTFE (100 μm)/ Polyimide resin (75 μm)/ Unbridged PTFE (100 μm) | Lattice pattern | 0.08 | 0.08 | 10 μm |

TABLE 2-continued

| | Layer configuration (Thickness) | Array pattern of recessed portion | Initial frictional coefficient | Frictional coefficient after sheet pass | Wear Amount |
|---|---|---|---|---|---|
| Example 3 | Bridged PTFE (100 μm)/ Polyimide resin (75 μm)/ Unbridged PTFE (50 μm) | Lattice pattern | 0.08 | 0.08 | 10 μm |
| Example 4 | Bridged PTFE (100 μm)/ Polyimide resin (75 μm)/ Unbridged PTFE (200 μm) | Lattice pattern | 0.08 | 0.08 | 10 μm |
| Comparative Example 1 | Bridged PTFE (100 μm)/ Polyimide resin (75 μm) | Lattice pattern | 0.08 | 0.08 | 10 μm |
| Comparative Example 2 | Bridged PTFE (100 μm)/ Polyimide resin (75 μm)/ Polyimide resin (100 μm) | Lattice pattern | 0.08 | 0.08 | 10 μm |
| Example 5 | Bridged PTFE (100 μm)/ Polyimide resin (75 μm)/ Unbridged PTFE (100 μm) | Face-centered lattice pattern | 0.09 | 0.09 | 12 μm |
| Example 6 | Bridged PTFE (100 μm)/ Polyimide resin (75 μm)/ Unbridged PTFE (100 μm) | Pattern in which central lattice points of square face-centered lattices are shifted | 0.09 | 0.09 | 12 μm |
| Example 7 | Bridged PTFE (100 μm)/ Polyimide resin (75 μm)/ Unbridged PTFE (100 μm) | Pattern in which central lattice points of square face-centered lattices are shifted | 0.09 | 0.09 | 12 μm |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sliding member for a fixing device comprising in order:

a first fluororesin layer having a sliding surface dotted with recessed portions;

a substrate; and a second fluororesin layer, wherein the recessed portions dotted in the sliding surface in the first fluororesin layer satisfy the following (1) and (2):

(1) the recessed portions show an array pattern obtained by shifting some or all of points of central portions in a lattice array from the lattice array obtained by continuously arranging basic arrays including a basic lattice that is configured by four lattice points and has one side parallel to a sliding direction and a point of a central portion of the basic lattice, each of the basic arrays is configured such that no recesses other than recesses corresponding to the four grid points and the central point exist inside a perimeter defined by the four grid points, and (2) on the sliding surface, except both side portions thereof, at least one recessed portion is present on any straight line parallel to the sliding direction of the sliding surface.

2. The sliding member for the fixing device according to claim 1, wherein the shape of the basic lattice in (1) is a parallelogram, and a distance in a direction orthogonal to the sliding direction between two sides parallel to the sliding direction is equal to or less than 3 times as large as a diameter of openings of the recessed portions in the direction orthogonal to the sliding direction.

3. The sliding member for the fixing device according to claim 2, wherein a cycle of the array pattern of the recessed portions is from 0.2 mm to 2.0 mm, and an area of an opening per one recessed portion is from $7\times10^{-3}$ mm$^2$ to 3.2 mm$^2$.

4. The sliding member for the fixing device according to claim 3, wherein a percentage of a total area of the openings of the recessed portions accounts for 10% to 60% of a total area of the sliding surface.

5. The sliding member for a fixing device according to claim 2, wherein a percentage of a total area of the openings of the recessed portions accounts for 10% to 60% of a total area of the sliding surface.

6. The sliding member for the fixing device according to claim 1, wherein a cycle of the array pattern of the recessed portions is from 0.2 mm to 2.0 mm, and an area of an opening per one recessed portion is from $7\times10^{-3}$ mm$^2$ to 3.2 mm$^2$.

7. The sliding member for the fixing device according to claim 6, wherein a percentage of a total area of the openings of the recessed portions accounts for 10% to 60% of a total area of the sliding surface.

8. The sliding member for the fixing device according to claim 1, wherein a percentage of a total area of openings of the recessed portions accounts for 10% to 60% of a total area of the sliding surface.

9. A fixing device comprising:

a first rotary member;

a second rotary member that is arranged in contact with an external surface of the first rotary member;

a pressing member that is arranged inside the second rotary member and presses the second rotary member against the first rotary member from an inner surface of the second rotary member; and the sliding member according to claim 1 that is interposed between the inner surface of the second rotary member and the pressing member.

10. The fixing device according to claim 9, wherein a surface roughness Ra of the inner surface of the second rotary member is from 0.1 μm to 2.0 μm.

11. An image forming apparatus comprising:

an image holding member;

a charging device that charges the surface of the image holding member;

a latent image forming device that forms a latent image on the charged surface of the image holding member;

a developing device that develops the latent image with a toner to form a toner image;

a transfer device that transfers the toner image to a recording medium; and the fixing device according to claim 9 that fixes the toner image on the recording medium.

12. The sliding member for the fixing device according to claim 1, wherein the first fluororesin layer is a bridged PTFE; and the second fluororesin layer is an unbridged PTFE.

* * * * *